US009873588B2

(12) United States Patent
Thakare et al.

(10) Patent No.: US 9,873,588 B2
(45) Date of Patent: Jan. 23, 2018

(54) CABLE REEL WITH BRAKING

(71) Applicant: Amphenol Corporation, Wallingford, CT (US)

(72) Inventors: Rakesh Thakare, Danville, VA (US); Caichun Song, Changzhou (CN); Phillip Stanley Bowen, Chatham, VA (US); Marvin Bryant, Chatham, VA (US); Paul Richard Boucher, Callands, VA (US); Barry Holt, Ottawa (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/433,785

(22) Filed: Feb. 15, 2017

(65) Prior Publication Data

US 2017/0158455 A1 Jun. 8, 2017

Related U.S. Application Data

(62) Division of application No. 14/634,007, filed on Feb. 27, 2015, now Pat. No. 9,695,008.

(51) Int. Cl.
*B65H 75/30* (2006.01)
*B65H 49/32* (2006.01)
(Continued)

(52) U.S. Cl.
CPC ..... *B65H 75/30* (2013.01); *B65H 49/205* (2013.01); *B65H 49/305* (2013.01);
(Continued)

(58) Field of Classification Search
CPC .... B65H 49/205; B65H 49/305; B65H 49/32; B65H 49/324; B65H 49/325; B65H 49/34; B65H 75/14; B65H 75/22; B65H 75/30
See application file for complete search history.

(56) References Cited

U.S. PATENT DOCUMENTS 1,990,135 A 2/1935 Sato
2,033,578 A 3/1936 Kittel
(Continued)

FOREIGN PATENT DOCUMENTS

EP 0 922 003 A1 6/1999
EP 2017211 A1 * 1/2009 ..... B65H 49/325

OTHER PUBLICATIONS

Times Fiber Communications; Inovative Broadband Solutions; Tech Service Bag, pp. 1-2.

*Primary Examiner* — William E Dondero
(74) *Attorney, Agent, or Firm* — Blank Rome LLP; Charles R. Wolfe, Jr.; Tara L. Marcus

(57) ABSTRACT

A cable reel that has at least one support frame having an outwardly extending braking gear member, the outwardly extending gear member being located off-center on the frame; a first flange having a central opening and a first hub portion surrounding the central opening, the central opening having an internal braking gear member engaging the outwardly extending gear member of the frame, thereby rotatably coupling the at least one support frame and the first flange; and a second flange opposing the first flange, the second flange having a second hub portion, the first and second hub portions being configured to mate with one another to support cable, wherein the engagement of the gear members providing a friction for cable payoff.

9 Claims, 10 Drawing Sheets

(51) Int. Cl.

| | |
|---|---|
| ***B65H 75/22*** | (2006.01) |
| ***B65H 75/14*** | (2006.01) |
| ***B65H 49/20*** | (2006.01) |
| ***B65H 49/30*** | (2006.01) |

(52) U.S. Cl.
CPC ..... *B65H 49/325* (2013.01); *B65H 75/14* (2013.01); *B65H 75/22* (2013.01)

(56) References Cited

U.S. PATENT DOCUMENTS

| | | | | |
|---|---|---|---|---|
| 2,400,417 | A | 5/1946 | Hickey | |
| 2,965,331 | A | 12/1960 | Nagy | |
| 3,693,784 | A | 9/1972 | Holmes | |
| 3,836,093 | A | 9/1974 | Mozina et al. | |
| 4,650,073 | A | 3/1987 | Young | |
| 4,667,896 | A | 5/1987 | Frey et al. | |
| 5,139,210 | A | 8/1992 | Schaffer | |
| 5,810,283 | A | 9/1998 | Shea | |
| 6,145,780 | A | 11/2000 | Fontana | |
| 6,234,421 | B1 | 5/2001 | Cox et al. | |
| 6,328,238 | B1 | 12/2001 | Chism | |
| 7,140,598 | B2 | 11/2006 | Verakis et al. | |
| 7,204,452 | B2 * | 4/2007 | Wilkinson | B65H 49/325 242/396.6 |
| 7,891,601 | B2 | 2/2011 | Higashisaka et al. | |
| 7,938,357 | B2 | 5/2011 | Johanson | |
| D641,161 | S | 7/2011 | Houston et al. | |
| D641,162 | S | 7/2011 | Houston et al. | |
| D641,163 | S | 7/2011 | Houston et al. | |
| 8,016,222 | B2 * | 9/2011 | Galgano | B62B 1/14 242/403 |
| 8,230,996 | B1 | 7/2012 | Cummings et al. | |
| 8,251,212 | B2 | 8/2012 | Dunlap | |
| 8,366,126 | B2 * | 2/2013 | Galgano | B62B 1/14 280/47.19 |
| 8,387,909 | B2 * | 3/2013 | Galgano | B62B 1/14 242/588.6 |
| 8,424,795 | B2 | 4/2013 | Galgano et al. | |
| D686,907 | S | 7/2013 | Chastain et al. | |
| 9,637,343 | B2 * | 5/2017 | Allwood | B65H 49/328 |
| 2006/0157366 | A1 | 7/2006 | Jamie | |
| 2010/0320309 | A1 * | 12/2010 | Galgano | B65D 5/5028 242/588.3 |
| 2015/0312159 | A1 | 10/2015 | Ertugay et al. | |

* cited by examiner

CABLE REEL WITH BRAKING

RELATED APPLICATION

This application is a Divisional of U.S. application Ser. No. 14/634,007, entitled Cable Reel, filed on Feb. 27, 2015, the disclosure of which is incorporated herein by reference in its entirety.

FIELD OF THE INVENTION

The present invention relates to a cable reel and also to a method for installing cable on the cable reel preferably with a cable payoff braking mechanism.

BACKGROUND OF THE INVENTION

Cable installers are commonly required to carry cable to installation locations. The installers usually use some type of shoulder bag or other types of packing solutions with an opening for paying out the cable. These cables are often wound on a reel to form a cable coil and packaged in a box or bag for payout during installations. The installer may, however, payout too much cable if the installer pulls too hard on the cable.

Therefore, a need exists for a cable reel that allows for easy installation of cable in a bag or the like and that prevents overpayout of the cable.

SUMMARY OF THE INVENTION

Accordingly, the present invention may provide a cable reel that has first and second opposing flanges. The first flange has a first hub portion and the second flange has a second hub portion. The first and second hub portions are axially aligned and configured to mate with one another to support cable, such as a cable coil. The first hub portion includes an elongated wall that extends from the first flange. The elongated wall is sized to support the cable. The elongated wall defines an inner area that is configured to accept the second hub portion. The elongated wall includes a plurality of flexible segments. The second hub portion includes a truncated wall that is receivable in the inner area of the first hub portion. The truncated wall includes a tapered outer surface for engaging and expanding the plurality of flexible segments.

The present invention may also provide a cable reel that includes at least one support frame that has an outwardly extending braking gear member. The outwardly extending gear member is located off-center on the frame. A first flange has a central opening and a first hub portion that surrounds the central opening. The central opening has an internal braking gear member that engages the outwardly extending gear member of the frame, thereby rotatably coupling the at least one support frame and the first flange. A second flange opposes the first flange and has a second hub portion. The first and second hub portions are configured to mate with one another to support cable. The engagement of the gear members provides a friction for cable payoff.

The present invention may further provide a method of installing the cable, such as a cable coil, on a cable reel that includes the steps of providing a cable reel that includes first and second opposing flanges, the first flange having a first hub portion and the second flange having a second hub portion, the first hub portion being longer than the second hub portion, and the first hub portion having a plurality of flexible segments; placing a cable coil over the first hub portion and on the first flange so that the first hub portion extends through the cable coil; and inserting the second hub portion inside of the first hub portion, thereby expanding the flexible segments so that the flexible segments engage the cable coil.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Referring to FIGS. 1-3, 4A, 4B, 5A, 5B, and 6-8, the present invention relates to a cable reel 100 that may be carried in a conventional shoulder bag or satchel, a cardboard or plastic box, and the like, with an opening for easy payout of cable supported on the cable reel. The cable reel 100 according to an exemplary embodiment of the present invention is designed to provide easy installation of cable, such as a cable coil, on the reel 100 and also prevents overpayout of the cable. Because the cable reel 100 is designed to be carried by an installer, it is preferable that the components of the cable reel 100 be formed of lighter weight materials, such as plastic. Some exemplary plastic materials include polyethylene, polypropylene, ABS or other polymer products.

Figure 1:
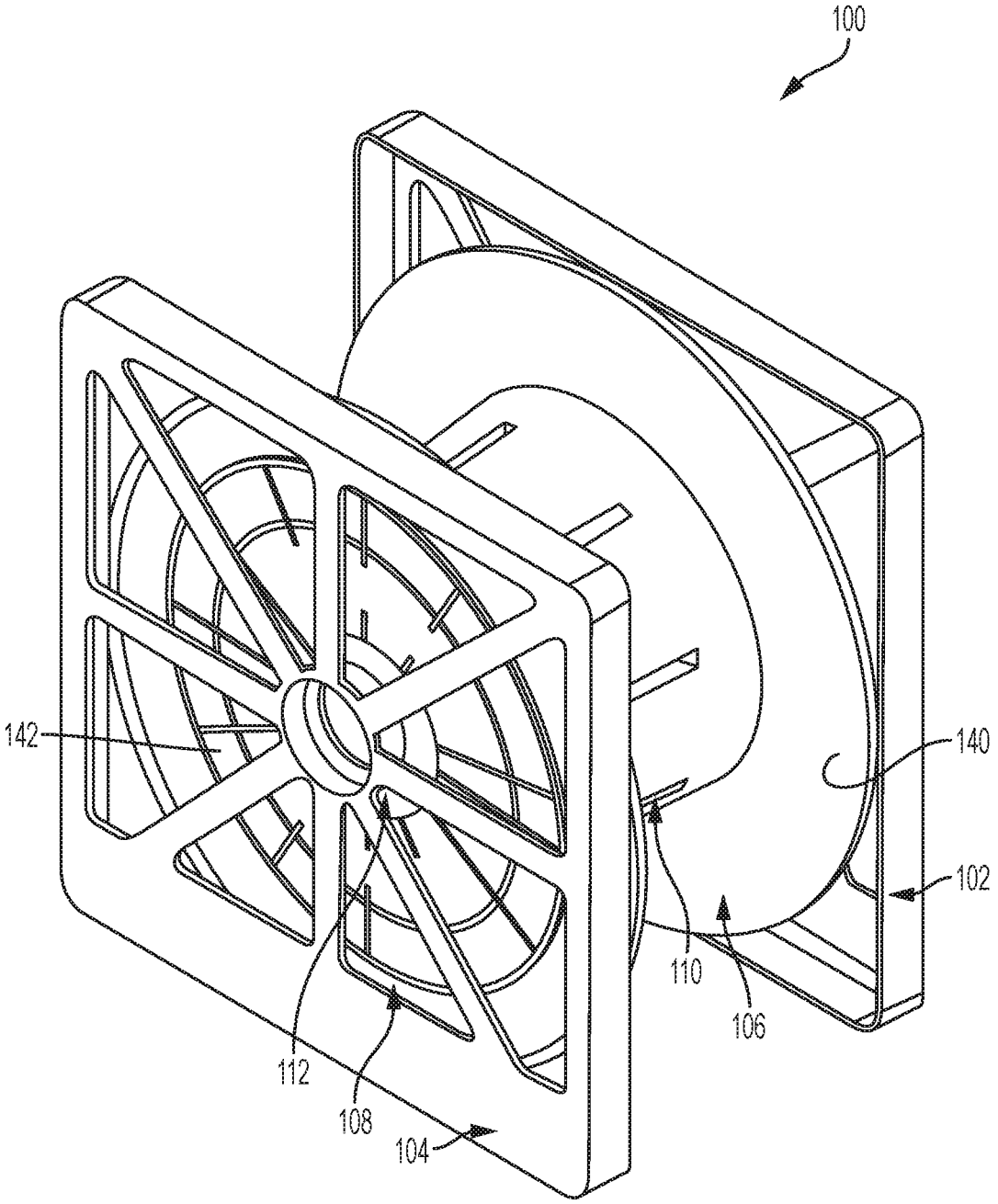
FIG. 1 is a perspective view of a cable reel in accordance with an exemplary embodiment of the present invention, shown without a supporting bag or box.

As seen in FIG. 1, the cable reel 100 generally includes opposing support frames 102 and 104 that rotatably support first and second flanges 106 and 108 with a hub member 110 therebetween on which the cable is held. A braking mechanism 112 is preferably provided on the reel 100 between the support frames 102 and 104 of the flanges 106 and 108 to limit overpayout of the cable. The cable reel 100 may be inserted into and supported by the payout bag or box wherein the support frames 102 and 104 are attached, preferably removably attached, to the cover and base, respectively, of the bag.

Figure 2:
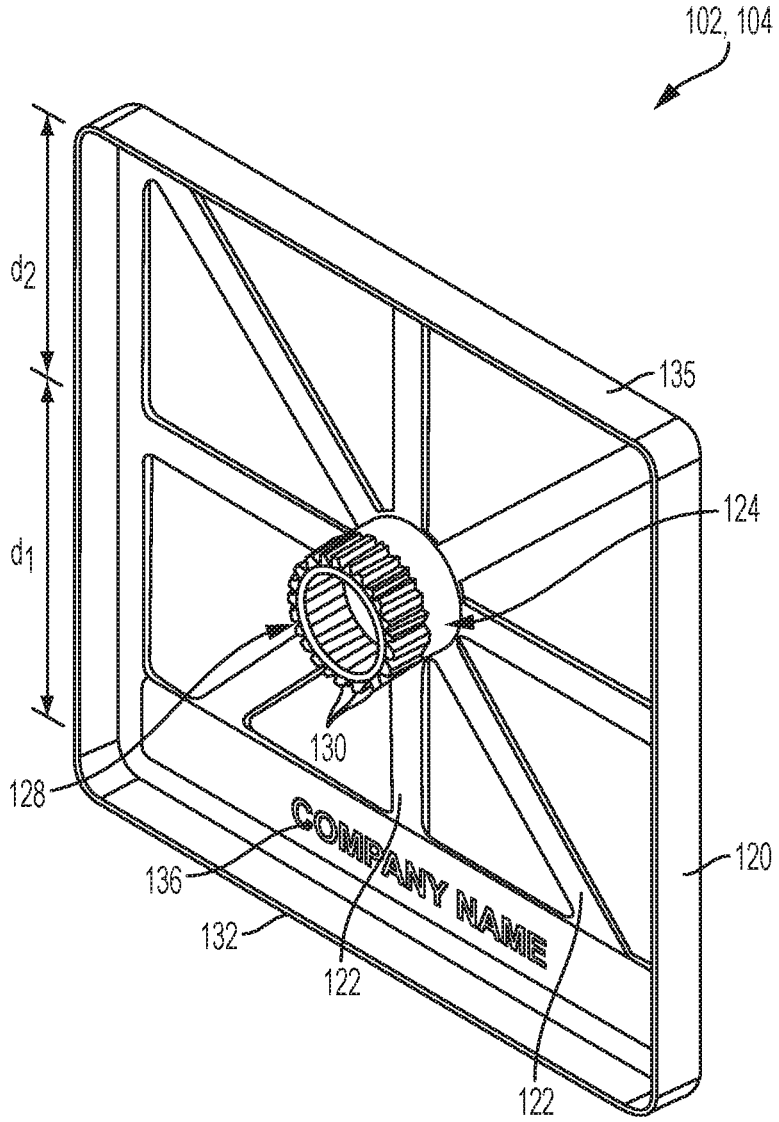
FIG. 2 is a perspective view of a support frame of the cable reel illustrated in FIG. 1.
Figure 3:
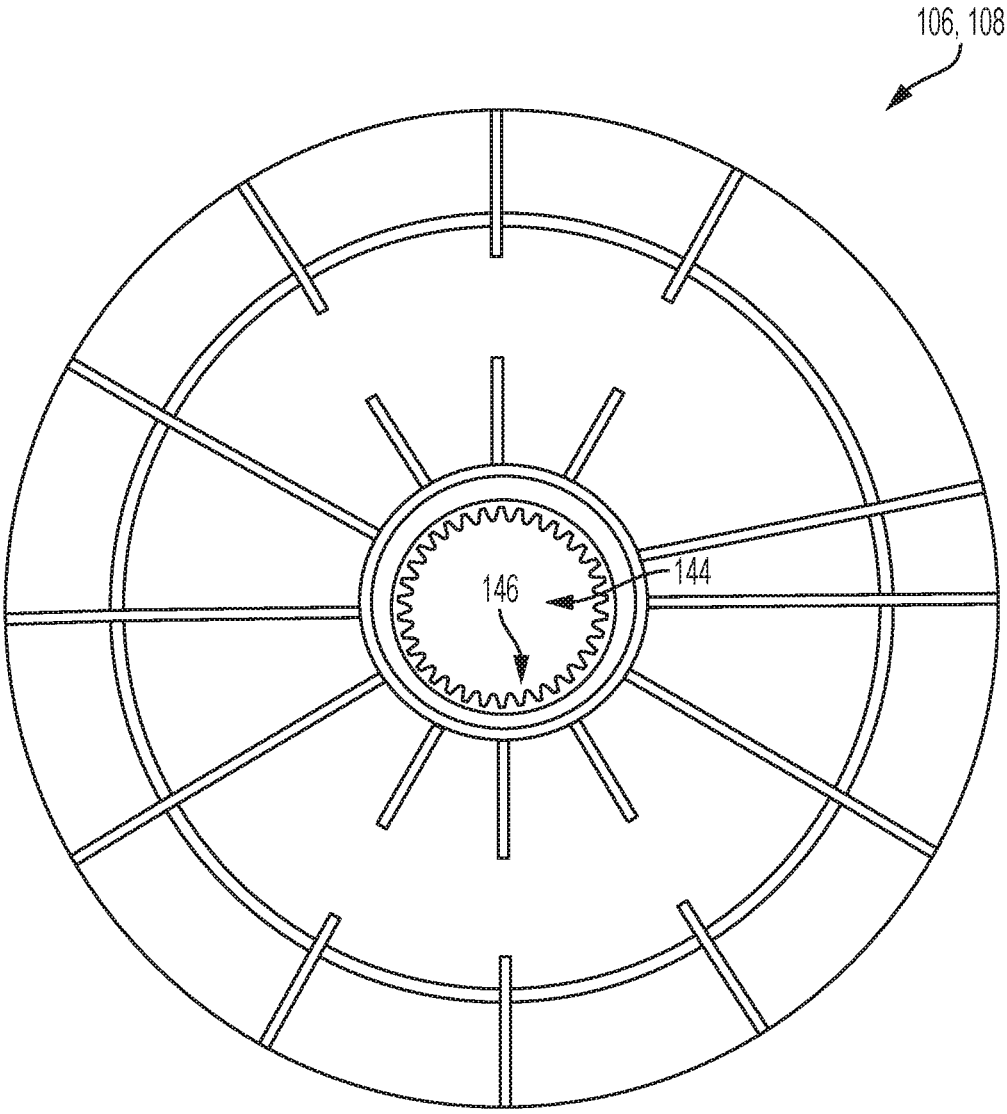
FIG. 3 is an elevational view of a flange of the cable reel illustrated in FIG. 1.
Figure 6:
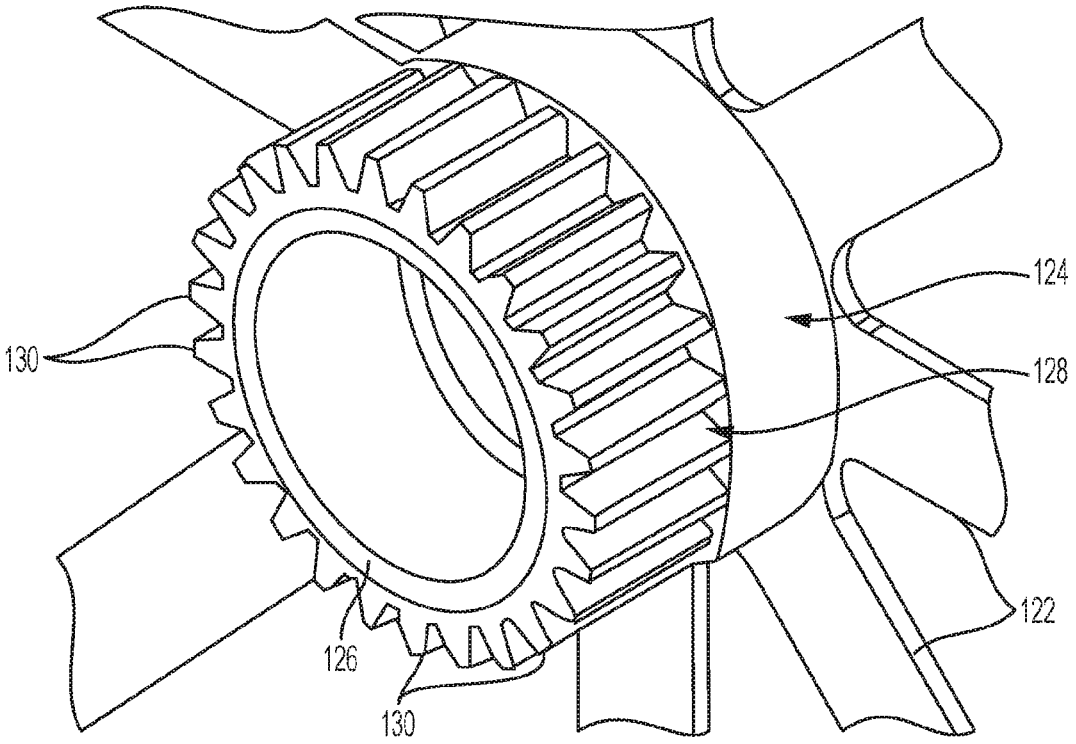
FIG. 6 is an enlarged partial perspective view of the frame illustrated in FIG. 2, showing outer gears of the frame.
Figure 7:
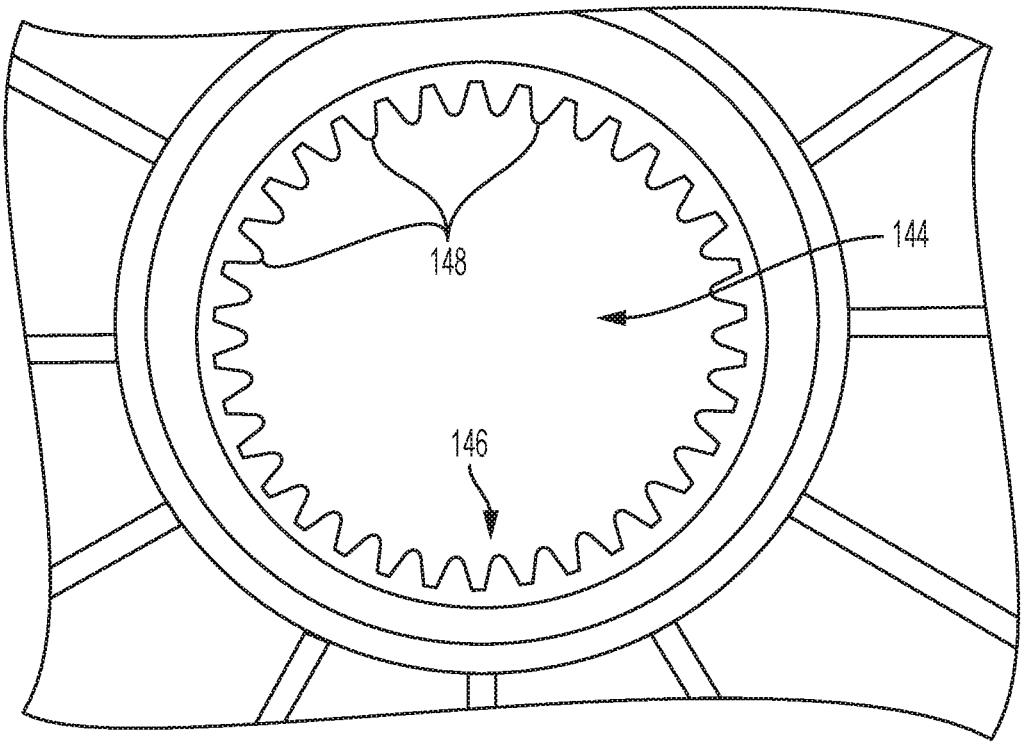
FIG. 7 is an enlarged partial side elevational view of the flange illustrated in FIG. 3, showing the inner gears of the flange.

As seen in FIGS. 2 and 6, each support frame 102 and 104 includes an outer frame portion 120 with one or more cross members 122 and a middle flange support 124. The outer frame portion 120 may have a substantially square geometry. The middle flange support 124 includes an annular extension 126 (FIG. 6) that supports a first part of the braking mechanism 112. The first part of the braking mechanism may be an outwardly extending gear member 128 that includes a plurality of annularly arranged teeth 130 extending radially outwardly from the annular extension 126.

Figure 8:
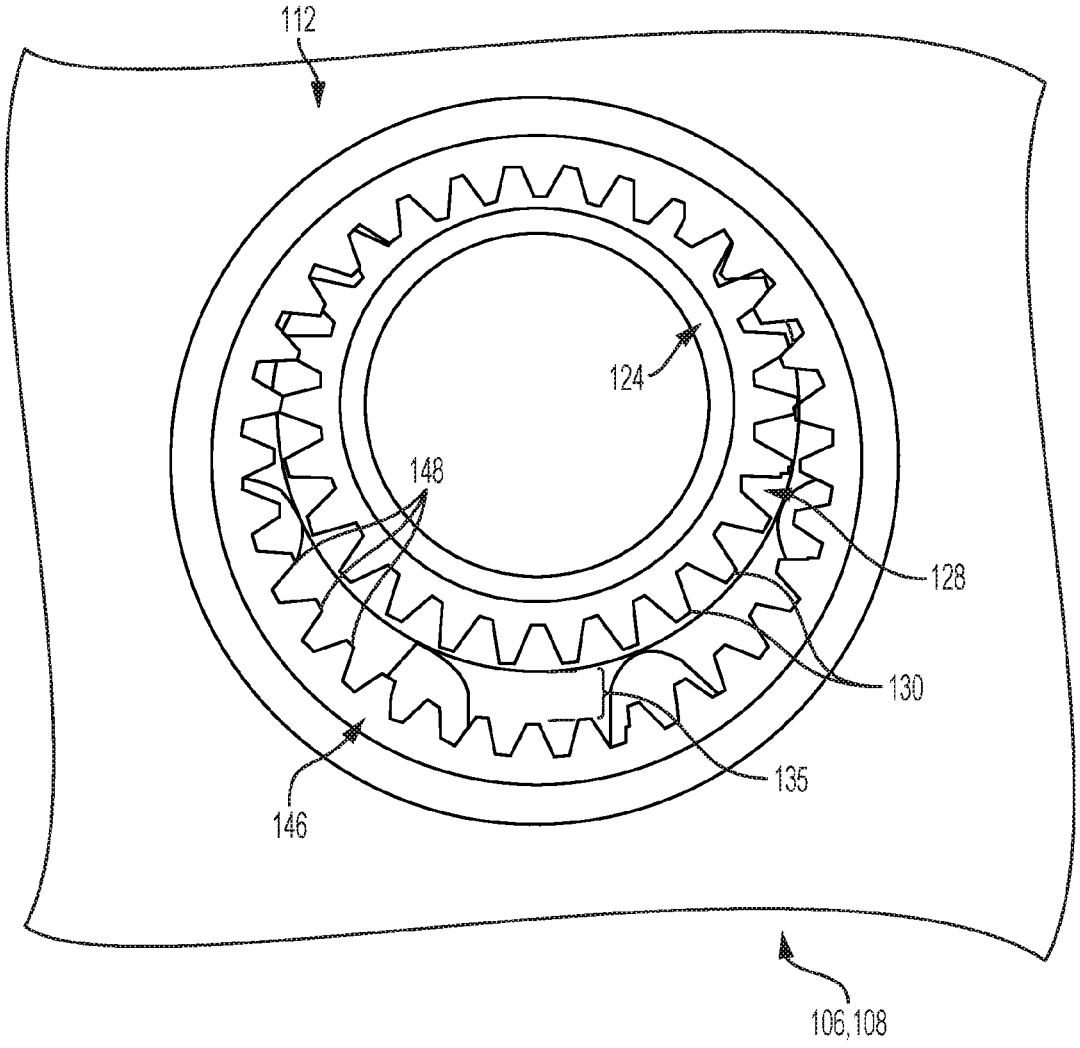
FIG. 8 is an enlarged side elevational view of the frame and the flange of the cable reel illustrated in FIG. 1, showing the inner and outer gears engaged.

The middle flange support 124 and gear member 128 are offset or off-center on the frame such that the distance $d_1$ (FIG. 2) to one end 132 of the frame is longer than the distance $d_2$ (FIG. 2) to the opposite end 135 of the frame. This offset provides a gap 134, as seen in FIG. 8, in the braking mechanism 112. Indicia 136, such as a company name, may be provided on the end 132 of the frame to indicate the longer side, that is distance $d_1$ of the frame to facilitate the orientation of the cable reel 100 in the bag or box.

Each flange 106 and 108 is preferably sized to fit within the outer frame portion 120 of its respective support frame 102 and 104 and is sized to accommodate the cable, such as a cable coil. The cable coil may be, for example, having an outer diameter of 345 mm and an inner diameter of 200 mm and a height of 135 mm. The flanges 106 and 108 are preferably disc-shaped. Each flange has inner and outer surfaces 140 and 142 and a central arbor opening 144. The inner surface 140 of each flange abuts the hub member 110 and the outer surface 142 abuts a respective support frame 102 and 104.

The central arbor opening 144 corresponds to the middle flange support 124 of each respective support frame. The central arbor opening 144 supports the second part of the braking mechanism 112 has seen in FIGS. 3 and 7. The second part of the braking mechanism 112 may be an internal gear member 146 that includes a plurality of annular arranged teeth 148 extending radially inwardly.

The hub member 110 is located between the flanges 106 and 108 and supports the cable coil. The hub member 110 includes a first hub portion 150 (FIGS. 4A and 4B) and a second hub portion 152 (FIGS. 5A and 5B) that are axially aligned and configured to mate with one another. The hub portions 150 and 152 may be formed separately from the respective flanges 106 and 108 and attached thereto or the hub portions 150 and 152 may be formed as one-piece with the respective flanges 106 and 108.

Figure 4A:
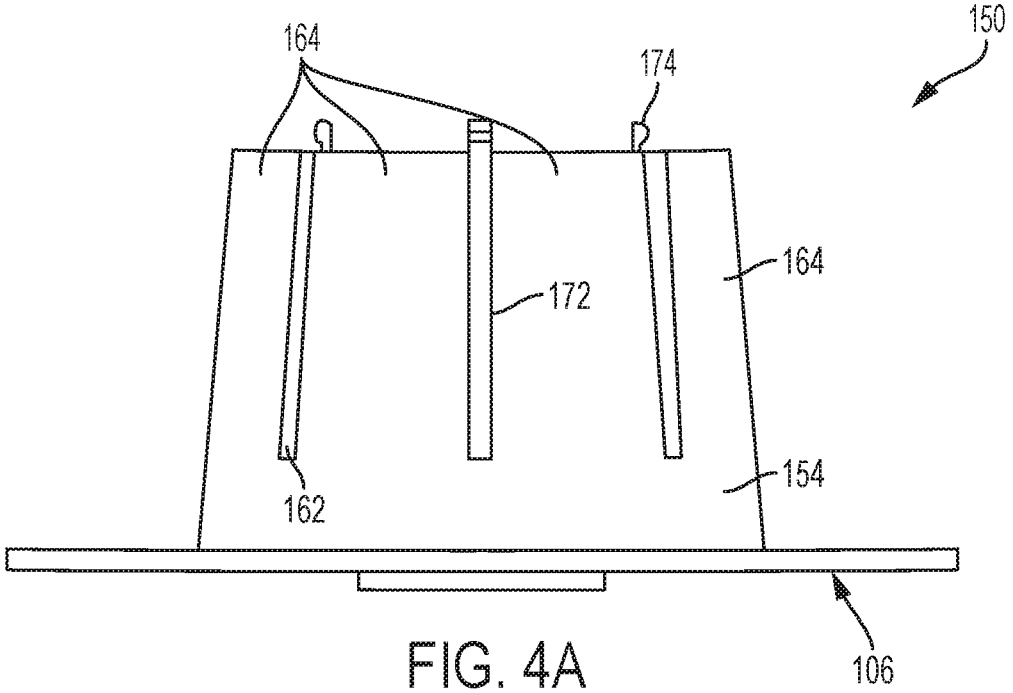
FIG. 4A is a perspective view of a first hub portion of the cable reel illustrated in FIG. 1.
Figure 4B:
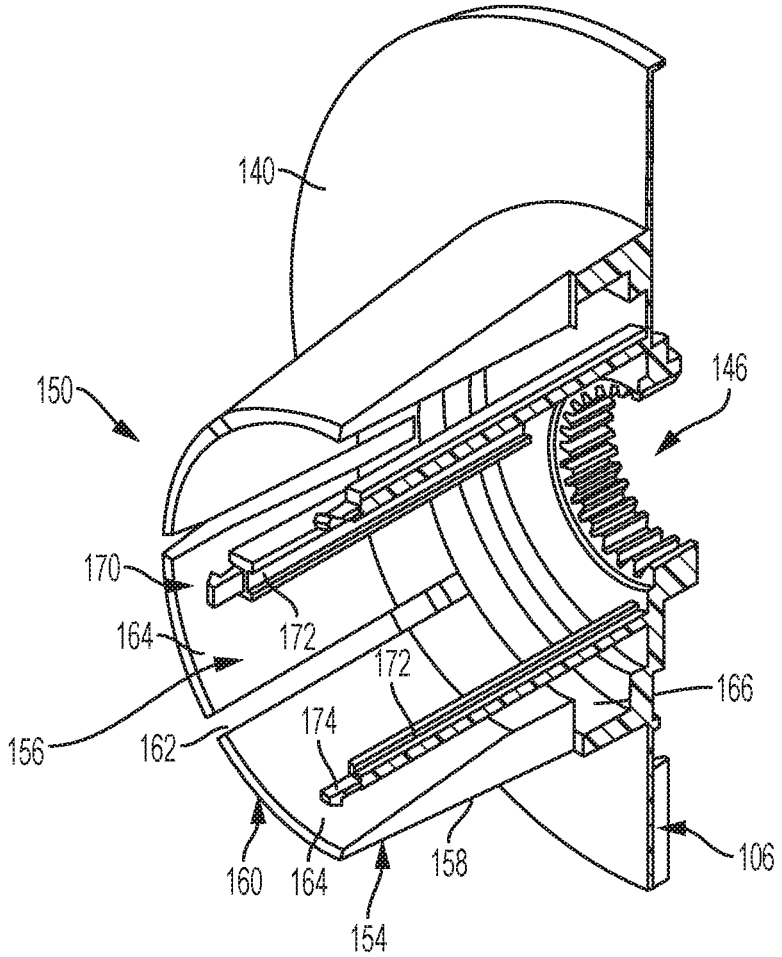
FIG. 4B is a partial perspective view of the first hub portion illustrated in FIG. 4A, showing the bottom hub in cross-section.

As seen in FIGS. 4A and 4B, the first hub portion 150 is preferably the base of the cable reel and provides the main support for the cable. As such, the first hub portion 150 is larger than the second hub portion 152. The first hub portion 150 includes an elongated wall 154 that extends from the inner surface 140 of the first flange 106 and defines an inner area 156 that receives the second hub portion 152. The elongated wall 154 has a tapered outer surface 158 that tapers inwardly from the flange inner surface 140 to the free end 160 of the wall 154. Slots 162 in the elongated wall 154 create flexible segments 164, which engage both the second hub portion 152 and the cable coil to retain the same. A groove 166 (FIG. 4B) may be located at the base of the elongated wall 154 to provide additional flexibility to the segments 164. Any other mechanism may be provided to add flexibility to the segments 164. For example, the segments 164 can be made thinner.

Secondary engagement members 170 may be provided as a back-up to retain the hub portions 150 and 152 together. The secondary engagement members 170 may be, for example, one or more snap arms 172 provided in the inner area 156 that extend from the flange inner surface 140. The one or more snap arms 172 preferably extend beyond the elongated wall 154 of the first hub portion 150, as seen in FIG. 4A, in order to engage the second flange 108. The ends of the snap arms 172 preferably include snap tabs 174 that engage corresponding slots 176 (FIG. 5B) in the second flange 108. Although a snapping engagement is preferred to secure the hub portions 150 and 152 together, any known interlocking mechanism may be used.

Figure 5A:
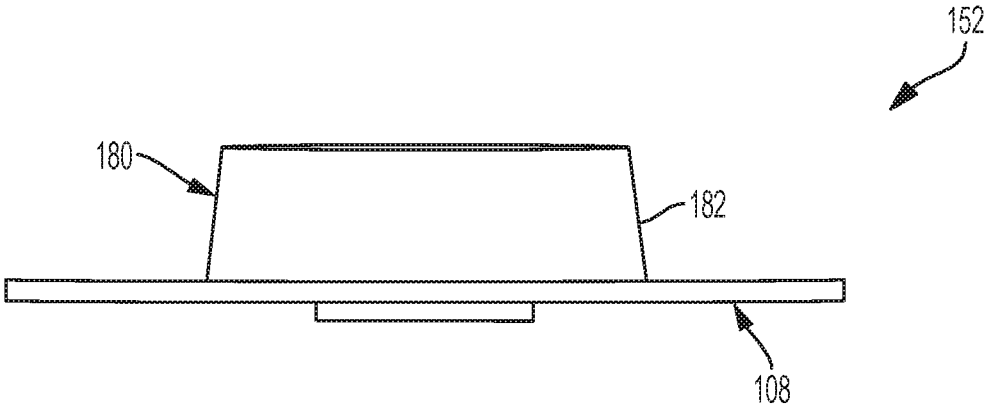
FIG. 5A is an elevational view of a second hub of the cable reel illustrated in FIG. 1.
Figure 5B:
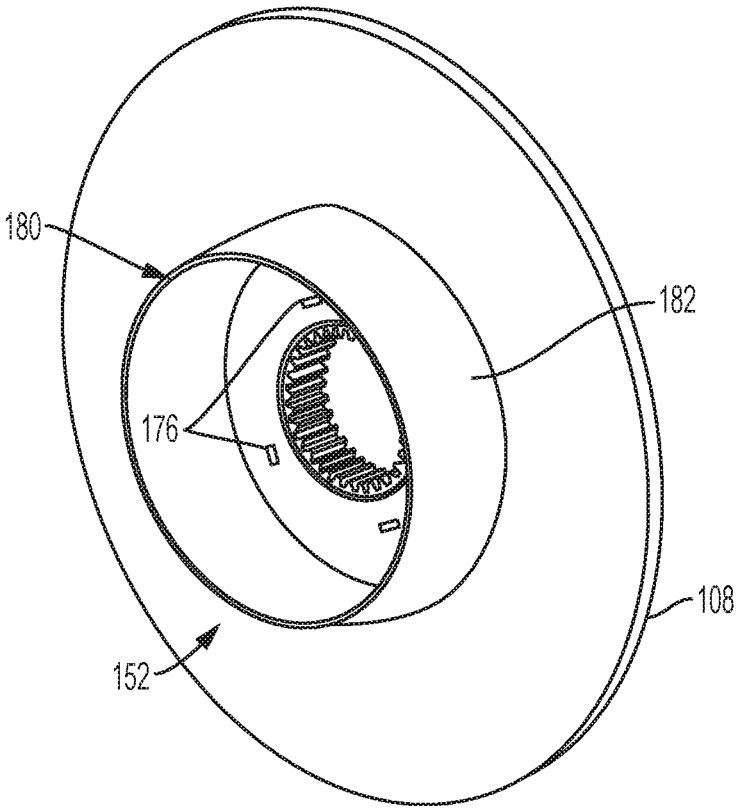
FIG. 5B is a perspective view of the second hub of the cable reel illustrated in FIG. 5A.

As seen in FIGS. 5A and 5B, the second hub portion 152 includes a truncated wall 180 that extends from the inner surface 140 of the second flange 108. The truncated wall 180 has a tapered outer surface 182 that fits inside of the elongated wall 154 of the first hub portion 150 to form a friction fit between the hub portions 150 and 152 and expands the flexible segments 164 of the first hub portion 150.

As seen in FIG. 8, the braking mechanism 112 is provided by meshing the teeth 130 and 148 of the outer and internal gear members 128 and 146. The gap 134 between the teeth 130 and 148 provides clearance for the teeth to slip or jump when the cable is pulled from the reel. The gear members 128 and 146 prevent overpayout of the cable. More specifically, when the cable is pulled from the reel, the flange 106 and 108 rotate, thereby making the gear teeth 148 rotate. The side support 120 is preferably fixed inside of the supporting bag or box and therefore does not rotate. This causes the gear teeth 148 to override meshing gear teeth 130 on the side support 128 which creates friction and provides a braking to the momentum of reel if the cable is pulled too hard. This action also creates a clicking mechanism which in turn prevents overpaying the cable.

The distance of the gap need only be long enough to provide a clearance to have gear teeth 148 to override teeth 130, thereby allowing the braking mechanism to work. This clearance distance could vary depending upon the gear teeth depth, flange hole inner diameter, side support gear depth, and the outer diameter of the middle flange support 124. The gap 134 may be, for example, about ¼ inch.

To install the cable on the cable reel 100, the cable coil is placed over the first hub portion 150 of the hub member 110 and on the first flange 106 so that the first hub portion 150 extends through the inner diameter of the cable coil. The cable coil may be prepacked in a plastic shrink wrap or with tie wraps or combination of both without any external structure to support that coil. Next the second hub portion 152 is inserted inside of the first hub portion 150 to frictionally engage the same and expand the flexible segments 164, thereby forcing the flexible segments 164 to engage the inner diameter of the cable coil. The locking tabs 174 are then inserted inside of the slots 176 on the second flange 108 to hold two flanges and hub portions together.

In a preferred embodiment, the first support frame 102 of the reel 100 is secured to the base of the bag or box, such as by straps, and the second support frame 104 is secured to the cover or flap of the bag. With the cable coil installed on the hub member 110, the cable coil is inserted into the bag or box between the support frames 102 and 104 in the bag or box. The assembly of the hub portions 150 and 152, the flanges 106 and 108, and the cable coil is preferably inserted into the base of the bag on its side such that the middle flange support 124 of the frame secured to the base of the bag fits inside of the central arbor opening 144 of the flange. Similarly, the middle flange support 124 of the frame secured to the cover of the bag fits inside of the opening 144 of the other flange when the bag is closed. Once the frames 102 and 104 are mated with the flanges 106 and 108, respectively, the operator can then dispense or payout the cable through a cable payout slot or opening in the bag or box. The operator may open the cover of the bag or box to separate the hub portions 150 and 152 by disengaging the snap tabs 174.

While particular embodiments have been chosen to illustrate the invention, it will be understood by those skilled in the art that various changes and modifications can be made therein without departing from the scope of the invention as defined in the appended claims.

What is claimed is:

1. A cable reel, comprising:

at least one support frame having an outwardly extending braking gear member, said outwardly extending gear member being located off-center on said frame;

a first flange having a central opening and a first hub portion surrounding said central opening, said central opening having an internal braking gear member engaging said outwardly extending gear member of said frame, thereby rotatably coupling said at least one support frame and said first flange; and a second flange opposing said first flange, said second flange having a second hub portion, said first and second hub portions being configured to mate with one another to support cable, wherein said engagement of said gear members providing a friction for cable payoff.

2. A cable reel according to claim 1, wherein each of said gear members including annularly arranged teeth, said teeth being configured for mesh engagement with each other.

3. A cable reel according to claim 2, wherein a gap is located between a portion of the mesh engagement of said teeth.

4. A cable reel according to claim 3, wherein said gap has a width that is the same as the distance said outwardly extending braking gear member is off-center from the center of said support frame.

5. A cable reel according to claim 1, wherein said first hub portion is longer than said second hub portion.

6. A cable reel according to claim 5, wherein said first hub portion includes an elongated wall that extends from said first flange, said elongated wall defines an inner area that is configured to accept said second hub portion, said elongated wall includes a plurality of flexible segments.

7. A cable reel according to claim 6, wherein said second hub portion includes a truncated wall that is receivable in said inner area of said first hub portion, said truncated wall includes a tapered outer surface for engaging and expanding said plurality of flexible segments.

8. A cable reel according to claim 1, further comprising a second support frame rotably coupled to said second flange, said second support frame having an outwardly extending braking gear mechanism that engages an internal braking gear mechanism of said second flange.

9. A cable reel according to claim 1, wherein said at least one support frame has a substantially square shape; and each of said first and second flanges has a substantially disc shape.

* * * * *